US006082638A

United States Patent [19]

Ask et al.

[11] Patent Number: 6,082,638

[45] Date of Patent: Jul. 4, 2000

[54] ANTI-ICING NOZZLE MOUNTING DEVICE

[75] Inventors: Bernard J. Ask; Tom Ask, both of St. Simons Island, Ga.

[73] Assignee: Odin Systems International, Inc., St. Simons Island, Ga.

[21] Appl. No.: 09/089,212

[22] Filed: Jun. 3, 1998

Related U.S. Application Data

[60] Provisional application No. 60/048,474, Jun. 3, 1997.

[51] Int. Cl.[7] ..... B05B 1/14

[52] U.S. Cl. ..... 239/548; 239/556; 239/600; 239/587.1; 239/202

[58] Field of Search ..... 239/200–202, 239/207, 104, 542, 548, 553, 266, 268, 271, 272, 390, 397, 450, 451, 309, 587.1, 594, 600; 404/2–4, 19, 71, 79

[56] References Cited

U.S. PATENT DOCUMENTS

| | | | |
|---|---|---|---|
| 212,719 | 2/1879 | Mansfield | 239/202 |
| 218,024 | 7/1879 | Hennessy et al. | 239/202 |
| 479,979 | 8/1892 | Glenn | 239/202 |
| 549,587 | 11/1895 | Schultze | 239/202 |
| 775,791 | 11/1904 | Austin | 239/202 |
| 789,588 | 5/1905 | Case | 239/202 |
| 802,772 | 10/1905 | McCoy | 239/202 |
| 2,070,665 | 2/1937 | Lepper | 239/450 |
| 2,800,367 | 7/1957 | Postlewaite et al. | 239/587.1 |
| 3,201,006 | 8/1965 | Bernhardt . | |
| 3,540,655 | 11/1970 | Hinrichs | 239/75 |
| 3,910,500 | 10/1975 | Hardison | 239/310 |
| 3,995,965 | 12/1976 | Cox | 404/71 |
| 4,161,280 | 7/1979 | Kasinakas | 239/1 |
| 4,161,290 | 7/1979 | Hill | 239/396 |
| 4,209,131 | 6/1980 | Barash et al. . | |
| 4,852,802 | 8/1989 | Iggulden et al. . | |
| 4,895,303 | 1/1990 | Freyvogel . | |
| 4,898,330 | 2/1990 | Betchan | 239/135 |
| 4,905,904 | 3/1990 | Ohara et al. | 239/284.1 |
| 5,021,939 | 6/1991 | Pulgiese . | |
| 5,024,553 | 6/1991 | Katsuragi | 404/71 |
| 5,060,859 | 10/1991 | Bancroft . | |
| 5,148,826 | 9/1992 | Bakhshaei . | |
| 5,287,888 | 2/1994 | Geiger . | |
| 5,447,272 | 9/1995 | Ask . | |
| 5,820,028 | 10/1998 | Dinur | 239/542 |

*Primary Examiner*—Andres Kashnikow
*Assistant Examiner*—Lisa Ann Douglas
*Attorney, Agent, or Firm*—James Creighton Wray; Meera P. Narasimhan

[57] ABSTRACT

The present invention provides a machine that applies chemical anti-icing agents to any surface to be protected from snow and ice, i.e., driveways, walkways, rooftops, etc. More specifically, the device is affixed to stationary surfaces and permits adjustment to spray nozzles. Thus liquid chemical anti-icing agents are applied to the target surfaces by spraying the liquid in a manner intended to prevent snow and ice from forming a bond with the target surface. The device permits the permanent installation of spray nozzles on, in or near the surface intended to be protected by anti-icing agents. The device is easily maintained and left in a state of preparedness for use in the event of icing conditions. The invention provides a durable, adjustable and permanent point of attachment for spray nozzles for anti-icing purposes. The device may be surface mounted or embedded in an existing structure. Use of the device greatly increases the margin of safety for users of the driveways, sidewalks, etc. Additionally, removing snow and ice by chemical anti-icing compound causes a reduction in the injuries and deaths caused by slippery surfaces and the physical discomfort of strenuous activity of manually shoveling the snow and ice.

32 Claims, 5 Drawing Sheets

ANTI-ICING NOZZLE MOUNTING DEVICE

This application claims the benefit of U.S. Provisional Application No. 60/048,474, filed Jun. 3, 1997.

BACKGROUND OF THE INVENTION

The application of anti-icing chemicals to surfaces by applying the liquid via spray nozzles is a well established practice, and devices used for spraying liquid anti-icing agents currently exist. All of these devices are truck or trailer mounted, while the current invention is a stationary nozzle mounting device.

The inventor of the current device, Bernard J. Ask, has received U.S. Pat. No. 5,447,272 for an automated anti-icing system, with both liquid and granular chemical variants. No adjustable nozzle mechanism is known, however, for providing an adjustable permanent nozzle installation to provide icing protection by a stationary, liquid anti-icing agent distribution system.

SUMMARY OF THE INVENTION

The present invention provides a machine that applies chemical anti-icing agents to any surface to be protected from snow and ice, i.e., driveways, walkways, rooftops, etc. More specifically, the device is affixed to stationary surfaces and permits adjustment to spray nozzles. That permits the application of the liquid chemical anti-icing agent to the target surfaces by spraying the liquid in a manner intended to prevent snow and ice from forming a bond with the target surface.

An objective of the present invention is to provide a device that permits the permanent installation of spray nozzles on, in or near the surface intended to be protected by a liquid chemical anti-icing compound, such as potassium acetate, calcium magnesium acetate, magnesium chloride, etc. by automatic, manual and remote control means.

The present invention is easily maintained and left in a state of preparedness for use in the event of icing conditions. The invention provides a durable, adjustable and permanent point of attachment for spray nozzles for anti-icing purposes. A primary benefit is a greatly increased margin of safety for the users of the driveways, sidewalks, etc. In addition, removing snow and ice by chemical means causes a reduction in the injuries and deaths relating to the physical strenuous activity of manually shoveling the snow and ice.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
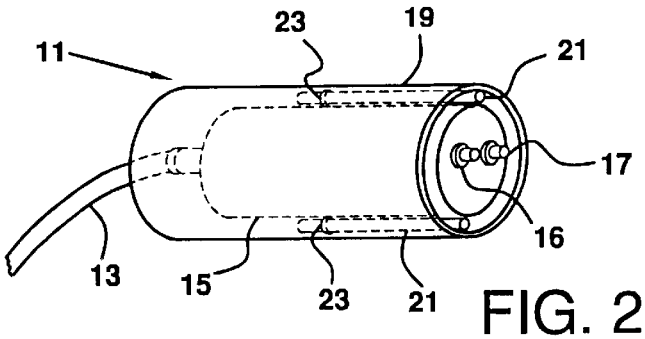
FIG. 1 is a perspective view of the anti-icing nozzle mounting device showing locking cams.

Referring to FIG. 1, the anti-icing nozzle mounting device 11 has a threaded machine aperture for the liquid inlet 13 for receiving an anti-icing solution consisting of 20% concentrate mixed with water. The concentrate is potassium acetate, calcium magnesium acetate, magnesium chloride or any other acceptable anti-icing compound. The liquid inlet 13 feeds into the liquid distribution manifold or nozzle block 15. The manifold 15 has one or more nozzle receptacles 16. The nozzles 17 are either inserts or machined into the nozzle block 15. The nozzles 17 have a range of 5° to 175°, depending on whether a stream or flat spray is desired.

Figure 22:
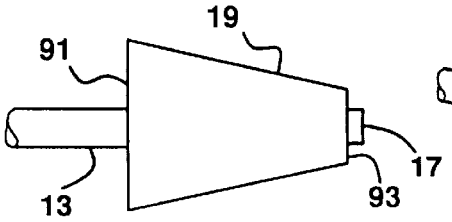
FIG. 22 is a side view of the anti-icing nozzle mounting device showing a conical sleeve.
Figure 23:
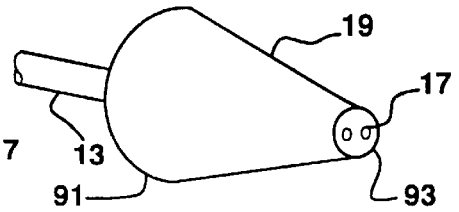
FIG. 23 is a perspective view of the anti-icing nozzle mounting device showing a conical sleeve.

The manifold 15 is contained within a tubular sleeve 19. The manifold 15 also contains two or more adjustment screws 21 that attach to the receptacle points within the sleeve 19 for adjusting the nozzle manifold in two axis. The sleeve 19 is made of a corrosion resistant material which is of sufficient hardness to accept one or more multiple locking cams 23. The sleeve 19 may be cylindrical as shown in FIG. 1, or conical as shown in FIGS. 22 and 23. As shown in FIGS. 22 and 23, the sleeve 19 is tapered from an inlet end 91 to an outlet end 93.

Figure 3:
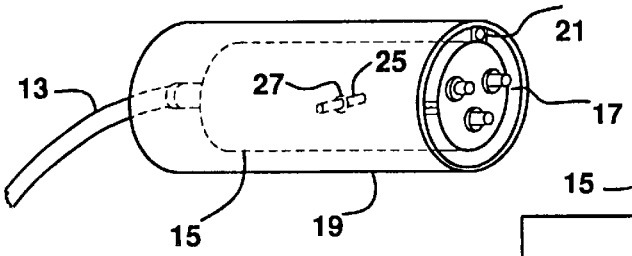
FIG. 3 is a perspective view of the anti-icing nozzle mounting device showing a slotted aperture for accommodating a pivot pin.

The cams 23 are inserted into slots 27 from the edge of the sleeve 19 with a hardened pin 25 pressed into the cam as shown in FIG. 3. The pin 25 serves as a fulcrum of the levering cam 23. The cam 23 pivots in an elliptical or off-center manner, with a machined tool receptacle controlling the rotation of the cam to lock the tubular sleeve 19 within a horizontal core. The horizontal core penetrates a concrete retaining wall, bridge parapet wall, roadway railing system, roadway median wall, parking garage bulkhead wall or other vertically aligned structure which is adjacent to, or in the vicinity of a surface upon which the liquid chemical anti-icing agent is to be distributed.

The tubular sleeve 19 may also be locked within a vertical core. The vertical core penetrates a concrete bridge span, concrete roadway, asphalt roadway, parking garage ramp, sidewalk, rooftop, runway, helipad or other horizontal structure located adjacent to, or in the vicinity of, a surface upon which the liquid chemical agent is to be distributed.

Figure 2:
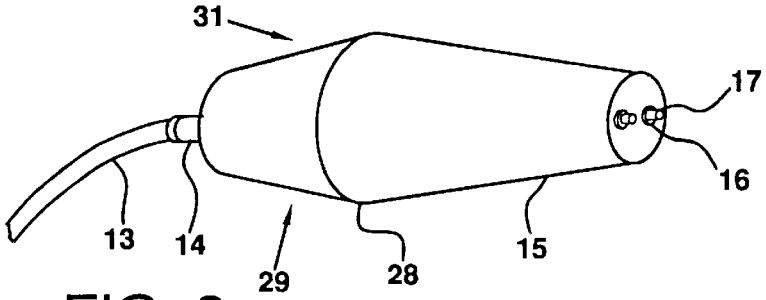
FIG. 2 is a perspective view of the anti-icing nozzle mounting device with a double tapered nozzle block.

Referring to FIG. 2, the anti-icing nozzle mounting device 31 has a threaded machine aperture 14 for the liquid inlet 13 for receiving an anti-icing solution consisting of 20% concentrate mixed with water. The concentrate is potassium acetate, calcium magnesium acetate, magnesium chloride or any other acceptable anti-icing compound. The liquid inlet 13 feeds into the liquid distribution manifold 15. The manifold 15 has one or more nozzle receptacles 16.

The nozzles 17 are either inserts or machined into the nozzle block 15. The nozzles 17 have a range of 5° to 175°, depending on whether a stream or flat spray is desired. The manifold 15 is machined to form a taper 29, with the greatest diameter at the midpoint 28 of the cylindrical manifold, and smaller diameters at each end. The taper 29 of the manifold 15 is to facilitate the adjustment of the nozzle mounting device 31 within a horizontal core.

Figure 4A:
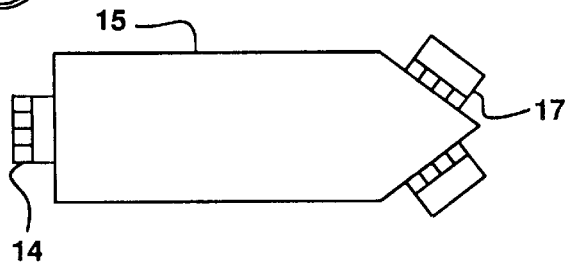
FIGS. 4A and 4B are a side view and a cross section of a polygon nozzle block, respectively.
Figure 4B:
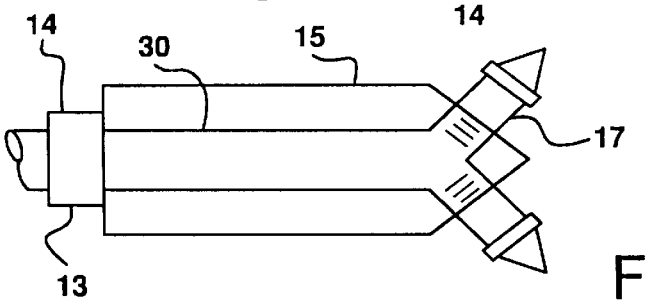

As shown in FIGS. 4A and 4B, nozzles 17 of a polygonal nozzle block 15 are connected to the inlet 13 via machined internal tubing 30 for chemical distribution.

Figure 5:
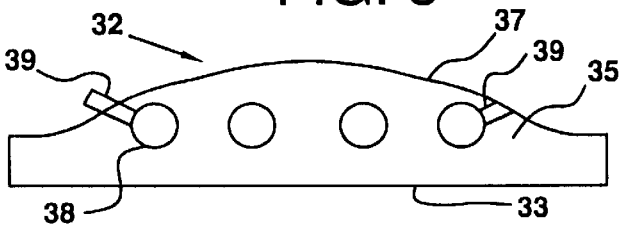
FIG. 5 is a cross-section of a spray strip.
Figure 6:
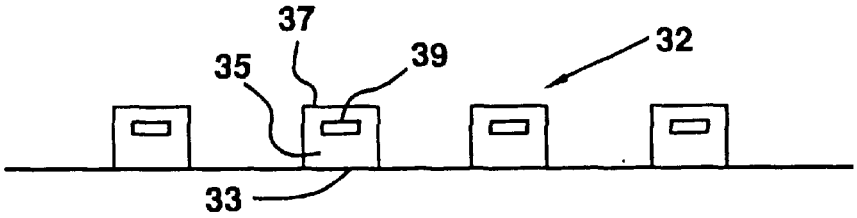
FIG. 6 is a side view of the spray strip.

FIG. 5 shows a cross-section of a spray strip 32 with the supply nozzles. 38 embedded therein between the base 33 and surface 37 in the body 35. Nozzle apertures 39 connect the nozzles 38 to the surface 37. FIG. 6 is a side view of the spray strip 32 with the nozzles 38 in the body 35.

Figure 7:
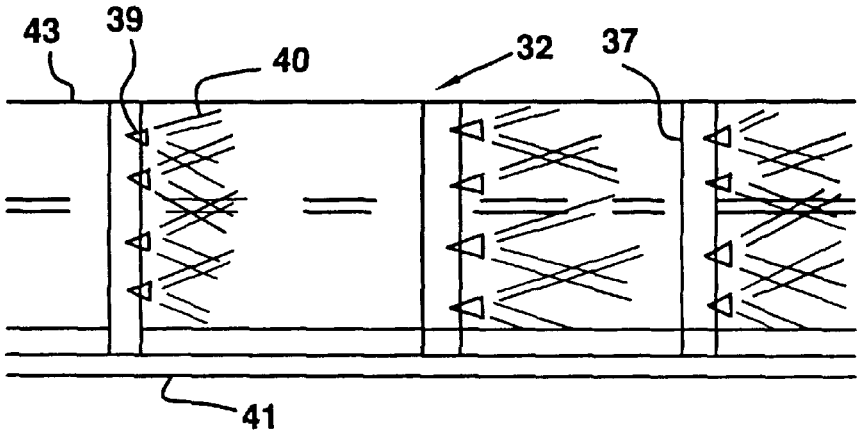
FIG. 7 is a top view of the spray strip in use in a roadway.

FIG. 7 shows spray strips in use on a roadway 43. The nozzles 31 are connected to the chemical supply manifold 41 that runs beneath the roadway 43. The nozzles 31 spray 40 the roadway 43 with the anti-icing agent supplied by the supply manifold 41.

Each preferred nozzle 17 is capable of distributing, but not limited to, a pint of anti-icing agent within the one second run-time. Generally, a half-gallon of anti-icing compound is required for covering a 1000 square foot area. The range of a preferred nozzle when distributing a stream is 150 feet, whereas the range is 12 to 15 feet when distributing a flat spray of the anti-icing compound.

The anti-icing nozzle mounting device is run by a battery, electrically or by a gas pump. The anti-icing nozzle may be operated automatically, manually or by remote control.

Figure 8:
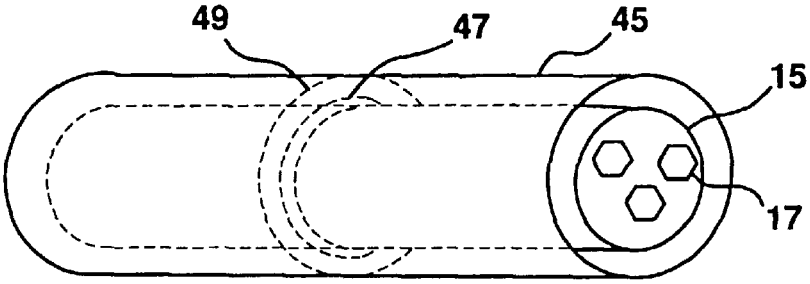
FIG. 8 is a perspective view showing rings positioned between the sleeve and the nozzle block.
Figure 9:
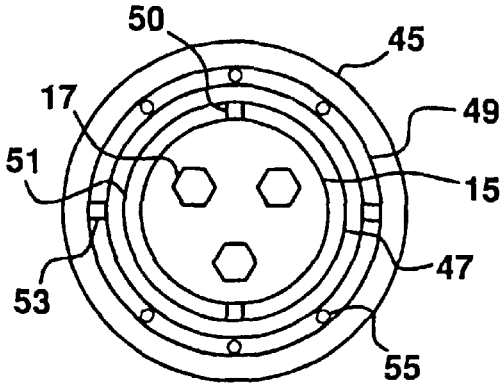
FIG. 9 is a front view of the nozzle mounting device of FIG. 8.

In another preferred embodiment of a nozzle shown in FIGS. 8 and 9, a sleeve 45 is provided on the nozzle block 15. Plural rings 47 and 49 are provided between the sleeve 45 and the nozzle block 15. Coaxial rings 47 and 49 are attached to a mounting strap 51, allowing for pivot points 53 between the rings. The outer ring 49 has alignment slots 55 that permit the inner ring 47 to rotate around the primary affixed outer ring. The inner ring 47 has alignment attachment points 50 for the nozzle block 15. The combination of alignment slots 55 and attachment points 50 allow the nozzle block 15 to be adjustable along three axes.

Figure 10:
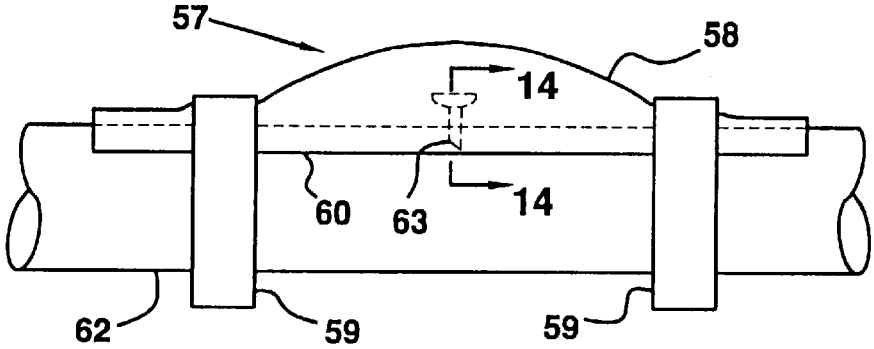
FIG. 10 is a side view of a clip-on nozzle.
Figure 11:
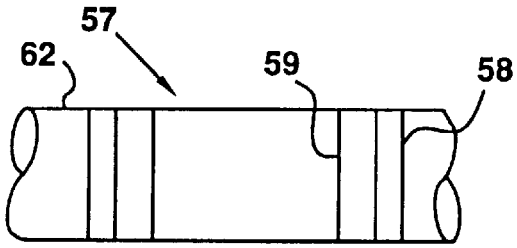
FIG. 11 is a top view of a clip-on nozzle.
Figure 12:
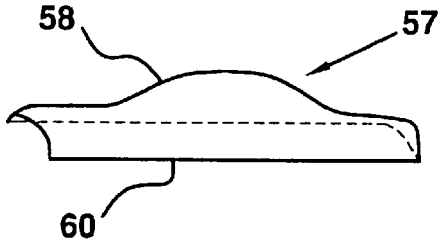
FIG. 12 is a perspective view of a rigid actuator plate.

FIGS. 10, 11, and 12 show a portable clip on nozzle 57 that can be attached by clamps 59. The rigid actuator plate 60 has rounded contours 58 to allow drive over. The pressure of a vehicle driving over the actuator plate 60 compresses the nozzle 57. Compressing the nozzle generates hydraulic pressure that forces chemical deicing agents out through the nozzles. The design allows for easy and customized location of the nozzle.

Figure 13:
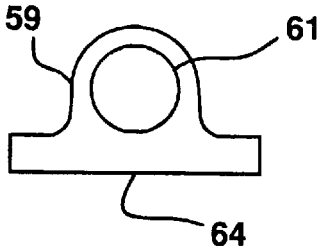
FIG. 13 is a front view of a clip-on nozzle strap.
Figure 14:
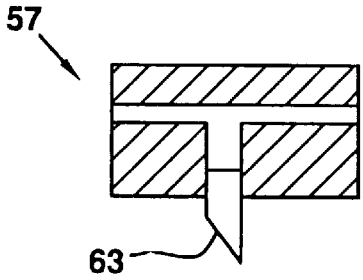
FIG. 14 is a cross-section of the clip-on nozzle piercing point.

FIG. 13 is a cross section of the clamp 59 showing an opening 61 for receiving the supply pipe 62. The clamp 59 has a flat base 64 for affixing to a roadway. FIG. 14 is a cross section of the nozzle 57 showing the pierce point 63.

Figure 15:
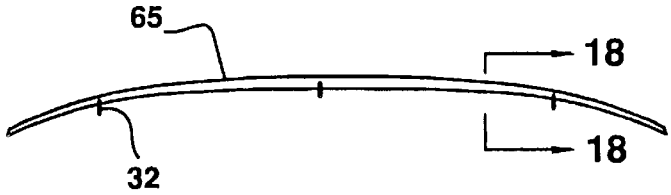
FIG. 15 is a cross-section of the spray strip body.
Figure 16:
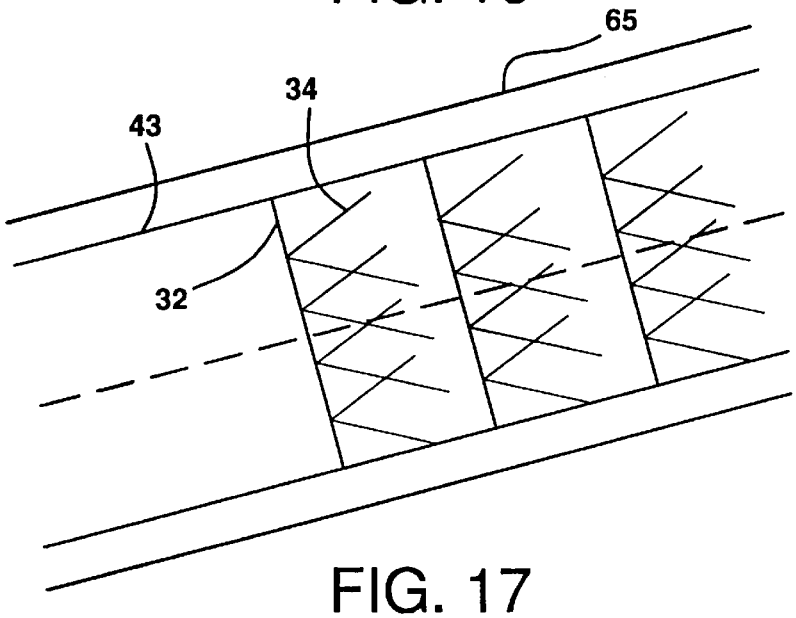
FIG. 16 is a top view of the deicing spray pattern.
Figure 17:
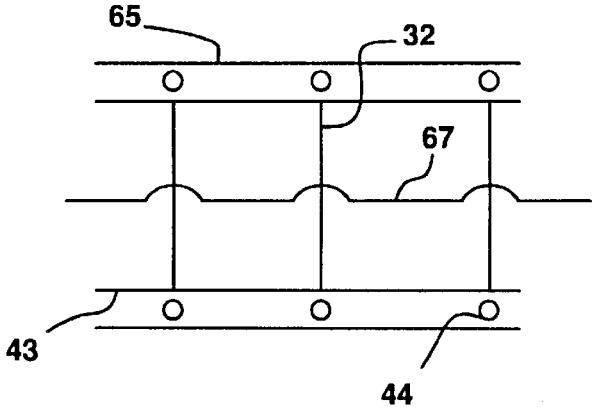
FIG. 17 is a top view of flexible spray bars.

FIG. 15 shows a flat molded plate attachment 65 on the nozzle that is preferably for winter use. FIG. 16 shows the spray plate 32 with the deicing/anti-icing spray 34. FIG. 17 is a side view of flexible spray bars 67 in the roadway.

Figure 18:
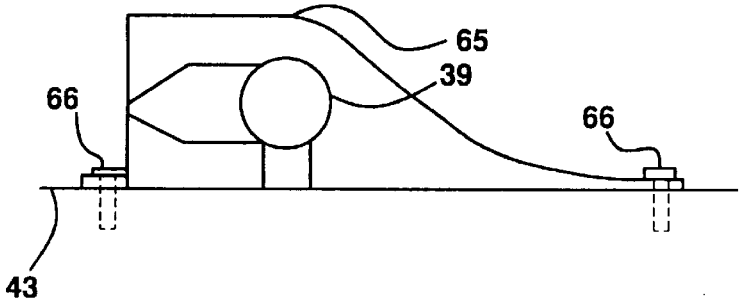
FIG. 18 is a cross-section of the spray strip.

Flexible spray bars 67 may be used instead of a flat plate attachment 65. Flexible spray bars are preferable for use in ramp applications. Mounting flanges 44 are used to secure the spray bar 32 to the roadway 43. FIG. 18 is a cross-section of the flat plate shown in FIG. 15. Fasteners 66 secure the flat plate 65 to the roadway 43.

Figure 19:
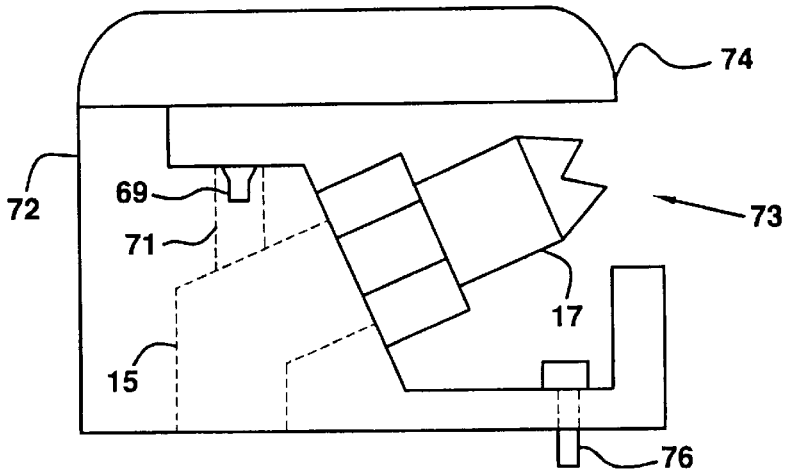
FIG. 19 is a cross-section of the nozzle.
Figure 20:
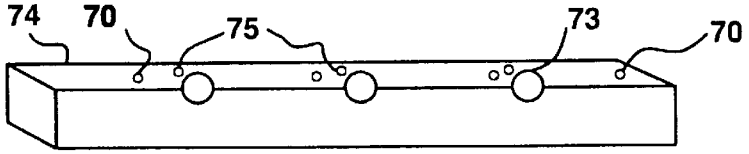
FIG. 20 is a perspective view of the adjustment bar.

In FIG. 19, a plug 69 is provided in the air blow out 71 connected to the nozzle block 15. FIG. 20 shows mounting means, such as screw access 70, provided on the monolithic structure cover 74. Spray openings 73 are provided in the structure cover 74, which is connected to the structure 72. Fasteners 76 secure the monolithic structure to the roadway.

Figure 21:
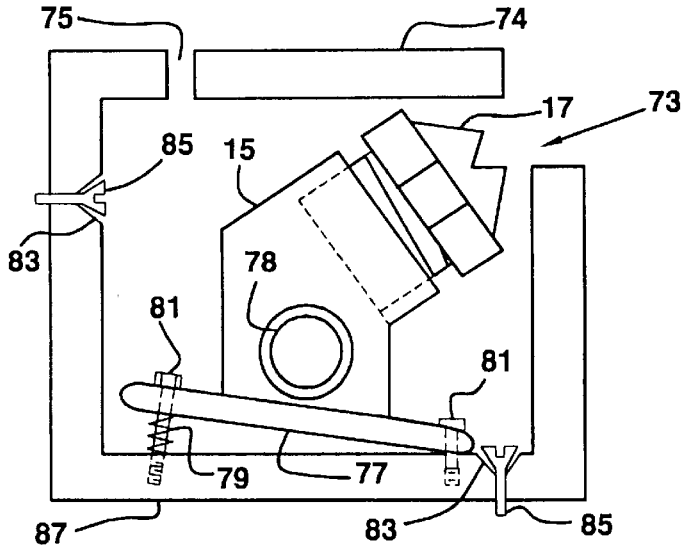
FIG. 21 is a cross-section of the nozzle with adjustment bar.

FIG. 21 shows a cross-section of the entire system in which the nozzle 17 is attached to the nozzle block 15 with its supply manifold 78. The nozzle block 15 is mounted on a spring 79 biased base 77. Adjustment screws 81 allow for alignment and positioning of the nozzle block 15. Mounting hardware 85 may additionally be used in openings 83 to anchor the channel housing 87. Access or adjustment holes 75 are provided in the structure cover 74.

While the invention has been described with reference to specific embodiments, modifications and variations of the invention may be constructed without departing from the scope of the invention, which is defined in the following claims.

We claim:

1. An apparatus for treating surfaces comprising a nozzle block, at least one inlet in the nozzle block for receiving deicing agents, and at least one outlet in the nozzle block for applying the deicing agents to targeted surfaces, further comprising a sleeve for housing the nozzle block, and further comprising a core for positioning proximal a surface to be de-iced, the sleeve being adjustably positioned in the core.

2. The apparatus of claim 1, wherein the at least one outlet is a nozzle machined integrally with the nozzle block.

3. The apparatus of claim 1, wherein the at least one outlet is adapted for receiving a nozzle.

4. The apparatus of claim 1, wherein the sleeve is conical.

5. The apparatus of claim 1, wherein an outer surface of the sleeve is tapered, and wherein a midpoint of the sleeve has a diameter greater than a remainder of the sleeve.

6. The apparatus of claim 1, further comprising at least one receptacle point in the sleeve, and at least one fastener receivable in the receptacle point for adjustably holding the nozzle block.

7. The apparatus of claim 1, further comprising an opening in the sleeve, and a locking cam with a pin receivable in the opening for pivotably holding the sleeve in the core.

8. The apparatus of claim 1, wherein the sleeve is of a corrosion resistant material.

9. The apparatus of claim 1, wherein the sleeve is cylindrical.

10. The apparatus of claim 1, wherein the nozzle block is cylindrical.

11. The apparatus of claim 1, wherein the nozzle block is of an insert material.

12. The apparatus of claim 1, wherein the sleeve is tapered.

13. The apparatus of claim 12, wherein the sleeve is tapered from an inlet end to an outlet end.

14. The apparatus of claim 12, wherein the sleeve has first and second ends.

15. The apparatus of claim 14, wherein the first end has the at least one inlet and the second end has the at least one outlet.

16. An apparatus for treating surfaces comprising a nozzle block, at least one inlet in the nozzle block for receiving deicing agents, and at least one outlet in the nozzle block for applying the deicing agents to targeted surfaces, a sleeve for housing the nozzle block, further comprising first and second rings positioned between the sleeve and the nozzle block.

17. The apparatus of claim 16, wherein the second ring has a smaller diameter than the first ring and wherein the second ring is positioned between the nozzle block and the first ring.

18. The apparatus of claim 17, further comprising alignment slots in the first ring for rotating the second ring around the first ring.

19. The apparatus of claim 18, further comprising attachment points in the second ring for securing to the nozzle block for allowing adjustment of the nozzle block.

20. An apparatus for treating surfaces comprising a spray strip, wherein the spray strip has an internal elongated cavity, an inlet in the spray strip for receiving anti-icing agents, an outer surface on the spray strip, at least one nozzle aperture connecting the outer surface to the internal cavity, and a nozzle connected to the at least one nozzle aperture for applying the anti-icing agents to targeted surfaces, further comprising mounting flanges on the outer surface of the spray strip for connecting to a roadway.

21. The apparatus of claim 20, wherein the spray strip is of an insert material.

22. The apparatus of claim 20, further comprising an outlet connected to the spray strip and a plug in the outlet.

23. The apparatus of claim 20, further comprising a manifold having a deicing agent adjacent the spray strip, a pierce point provided on the spray strip for puncturing the manifold and releasing the deicing agents, and a mounting flange on the pierce point for mounting on the spray strip.

24. The apparatus of claim 23, further comprising a self-sealing plug on the pierce point proximal the manifold forming a tight seal between the pierce point and the manifold for preventing leakage of the deicing agents.

25. An apparatus for treating surfaces comprising a channel, an inlet in the channel for supplying deicing agents, at least one nozzle in the channel for receiving the deicing agents, and at least one aperture in the channel communicating with the nozzle for applying the deicing agents to targeted surfaces, further comprising at least one fastener for securing a mounting plate to the channel, wherein the at least one fastener is a spring-loaded fastener.

26. An apparatus for treating surfaces comprising a channel, an inlet in the channel for supplying deicing agents, at least one nozzle in the channel for receiving the deicing agents, and at least one aperture in the channel communicating with the nozzle for applying the deicing agents to targeted surfaces, further comprising at least one fastener for securing a mounting plate to the channel, further comprising an opening in the channel permitting access to the at least one fastener for adjusting the nozzle mounting plate.

27. The apparatus of claim 26, further comprising a mounting plate on the channel and a nozzle block mounted on the mounting plate for receiving the at least one nozzle.

28. The apparatus of claim 27, wherein the inlet is in the nozzle block.

29. The apparatus of claim 26, wherein the at least one nozzle is mounted directly on an inner surface of the channel.

30. The apparatus of claim 26, wherein the channel is rectangular.

31. An apparatus for treating surfaces comprising a channel, an inlet in the channel for supplying deicing agents, at least one nozzle in the channel for receiving the deicing agents, and at least one aperture in the channel communicating with the nozzle for applying the deicing agents to targeted surfaces, further comprising an air blow out in the inlet.

32. The apparatus of claim 31, further comprising a plug in the air blow out for sealing the blow out.

* * * * *